US007431069B2

(12) United States Patent
Liang

(10) Patent No.: US 7,431,069 B2
(45) Date of Patent: Oct. 7, 2008

(54) METHOD AND APPARATUS FOR METAL CASTING

(76) Inventor: Fu Shun Liang, 13634 Darvalle St., Cerritos, CA (US) 90703

( * ) Notice: Subject to any disclaimer, the term of this patent is extended or adjusted under 35 U.S.C. 154(b) by 92 days.

(21) Appl. No.: 11/030,230

(22) Filed: Jan. 6, 2005

(65) Prior Publication Data

US 2006/0081351 A1 Apr. 20, 2006

Related U.S. Application Data

(60) Provisional application No. 60/619,321, filed on Oct. 16, 2004.

(51) Int. Cl.
*B22D 37/00* (2006.01)

(52) U.S. Cl. ..... 164/337; 164/358; 164/134

(58) Field of Classification Search ..... 164/134, 164/337, 136, 358; 75/407
See application file for complete search history.

(56) References Cited

U.S. PATENT DOCUMENTS 2,865,068 A * 12/1958 Dunn ..... 164/259
4,961,455 A * 10/1990 Redemske et al. ..... 165/63
5,169,542 A * 12/1992 Kaettlitz et al. ..... 210/767
5,336,295 A * 8/1994 DeYoung et al. ..... 75/407
5,673,902 A * 10/1997 Aubrey et al. ..... 266/229
6,485,541 B1 * 11/2002 Hryn et al. ..... 75/709
6,578,620 B1 * 6/2003 Trudel et al. ..... 164/312

* cited by examiner

*Primary Examiner*—Kevin P Kerns
(74) *Attorney, Agent, or Firm*—Paul J. Backofen, Esq.; Crockett & Crockett

(57) ABSTRACT

A technique for pressurized or differential pressure casting according to the present disclosure provides a riser tube filter formed of ceramic foam having a specific gravity lower than the molten metal to be cast. A riser tube filter according to the present invention may float in and/or on the molten metal within the riser tube and smooth the flow of molten metal within the riser tube simultaneously filtering the metal. As the molten metal is depressurized, a riser tube filter according to the present disclosure will travel back down the riser tube engaging the walls of the riser tube and minimizing the surface of molten metal in contact with the air or other gas. It is emphasized that this abstract is provided to comply with the rules requiring an abstract that will allow a searcher or other reader to quickly ascertain the subject matter of the technical disclosure. It is submitted with the understanding that it will not be used to interpret or limit the scope or meaning of the claims.

9 Claims, 2 Drawing Sheets

METHOD AND APPARATUS FOR METAL CASTING

RELATED APPLICATIONS

This application claims the priority of U.S. provisional patent application Ser. No. 60/619,321 filed Oct. 16, 2004.

BACKGROUND OF THE INVENTION

1. Field of the Invention

This invention relates to casting and more specifically to methods and apparatus for cost effective metal casting.

2. Description of the Prior Art

Conventional methods of automated metal casting often use metal filter grates, placed by hand, at the interface of the riser tube and the mold. This approach requires hand labor and introduces potential impurities to the process. When the molten metal is depressurized the introduction of oxygen into the riser tube forms metal oxides that form layers within the riser tube changing the process parameters with every casting and introducing further impurities into the process.

When casting softer metals such as aluminum the steel filter screen in the casting sprue may be cut by a die during removal of the sprue, thus shortening the useful life of the die. The presence of the filter screen within the sprue may also serve as a heat conductor enhancing the cooling of the sprue before cooling of the main casting improving the likelihood of voids in the casting.

What is needed is a technique to minimize hand labor in semi-automated metal casting, reduce the likelihood of introducing impurities, stabilize the casting process and improve control of the casting process.

SUMMARY OF THE INVENTION

The present disclosure is directed to filtering pressurized or differential pressure casting to obtain superior results. In a first aspect, the present disclosure provides a riser tube filter having a specific gravity lower than the molten metal to be cast. A riser tube filter according to the present invention may float in and/or on the molten metal within the riser tube and smooth the flow of molten metal within the riser tube simultaneously filtering the metal. The floating riser tube filter retains the temperature of the molten material and thus doesn't impact the casting process by drawing heat from the first material to enter the mold.

In another aspect of the present disclosure, as the molten metal is depressurized, a riser tube filter according to the present disclosure will travel back down the riser tube engaging the walls of the riser tube and minimizing the surface of molten metal in contact with the air or other gas. The improved filtration and smooth casting flow of the present disclosure permits casting of complicated shapes such as engine blocks or other components with stringent mechanical demands. This may allow reduces weight wheel castings due to improved mechanical properties.

In still another aspect of the present disclosure, a riser tube filter may be formed of single density ceramic foam into a generally spherical shape sized to move smoothly through the riser tube while engaging the inner surface of the riser tube.

In a further aspect of the present disclosure, a floating riser tube filter may have two or more filter densities.

In another further aspect of the present disclosure, a pressurized casting filter may be shaped to retain a particular orientation within a riser tube or mold adapter. An orientation controlling filter may also include a solid area at one end to replace the spreader generally required in mold adapters to direct the flow of the molten material.

These and other features and advantages of this disclosure will become further apparent from the detailed description and accompanying figures that follow. In the figures and description, numerals indicate the various features of the disclosure, like numerals referring to like features throughout both the drawings and the description.

DETAILED DESCRIPTION OF THE PREFERRED EMBODIMENT(S)

Figure 1:
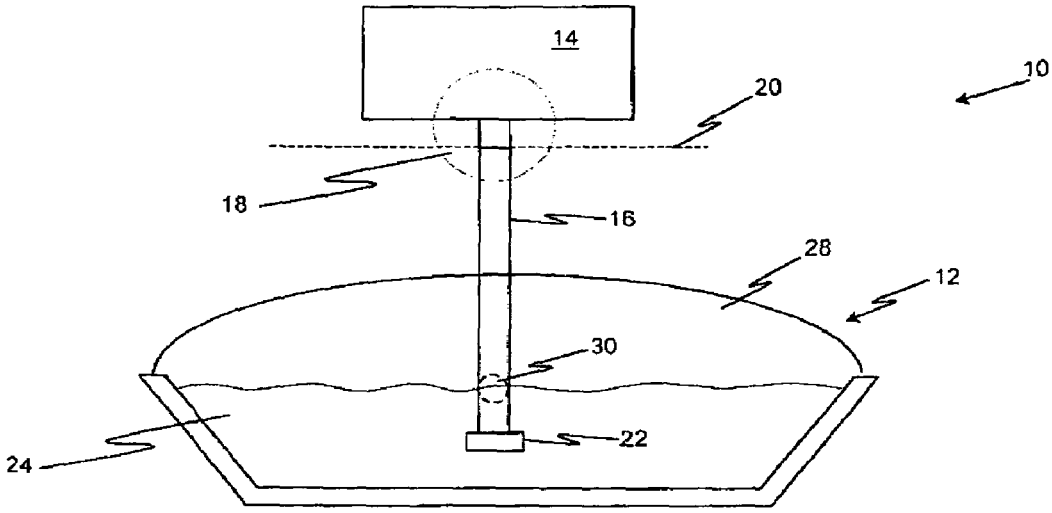
FIG. 1 is a block diagram of a casting apparatus according to the present disclosure.

Referring now to FIG. 1, in a currently preferred embodiment of the present disclosure casting apparatus 10 includes casting machine 12, riser tube 16 and mold 14. Molten metal 24 within casting machine 12 may be forced through riser tube 16 by pressure in area 28 within casting machine 12. Ceramic sponge filter 22 may also be used to provide initial filtration to molten metal 24 as well as smoothing the flow of molten metal 24 into riser tube 16. Interface 20 generally provides a separation between casting machine 12 and mold 14. Ceramic sponge riser tube filter 30 is free to rise within riser tube 16 with the flow of molten metal 24.

Figure 2:
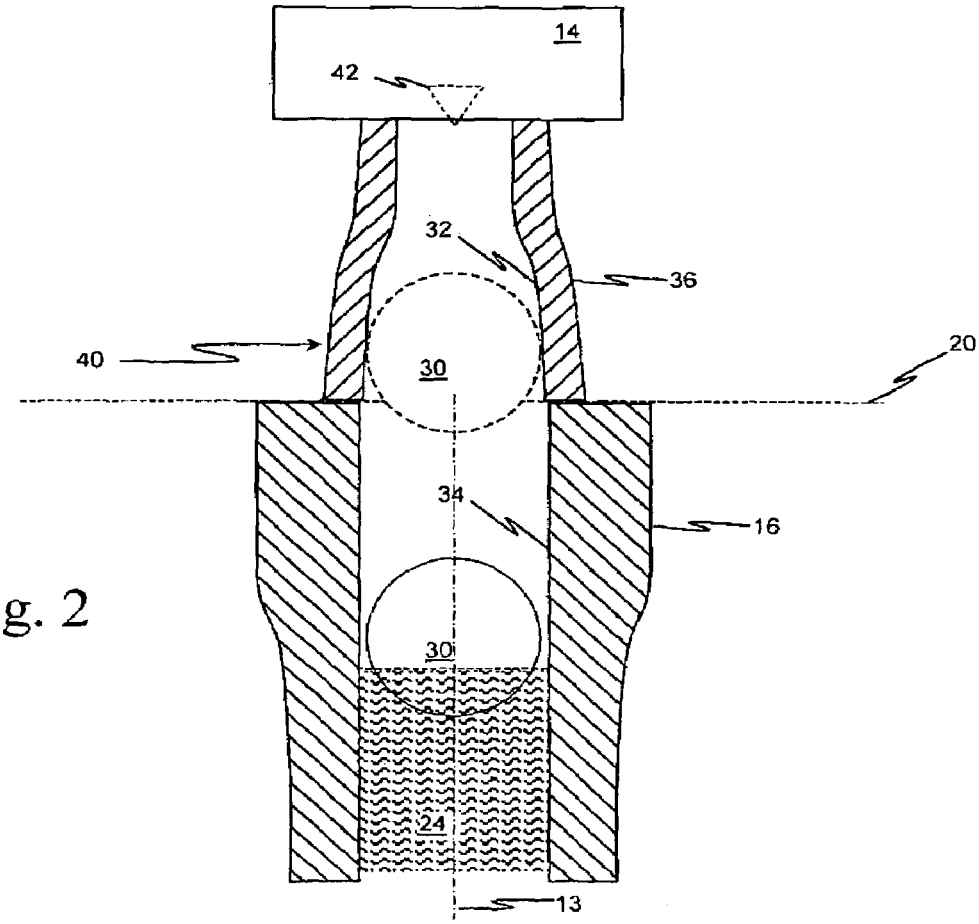
FIG. 2 is a cross-section of detail area 18 of FIG. 1.
Figure 3:
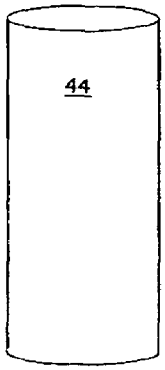
FIG. 3 is a side view of an alternate embodiment of a floating riser tube filter according to the present disclosure.
Figure 4:
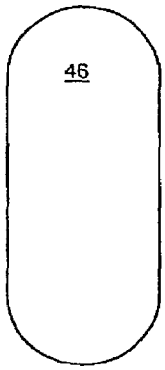
FIG. 4 is a side view of another alternate embodiment of a floating riser tube filter according to the present disclosure.
Figure 5:
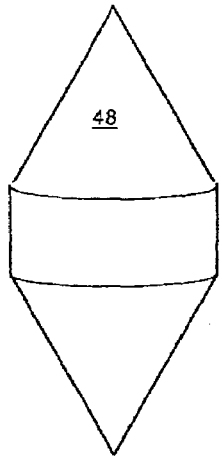
FIG. 5 is a side view of a further alternate embodiment of a floating riser tube filter according to the present disclosure.
Figure 6:
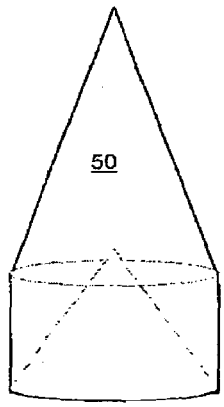
FIG. 6 is a side view of a still further alternate embodiment of a floating riser tube filter according to the present disclosure.
Figure 8:
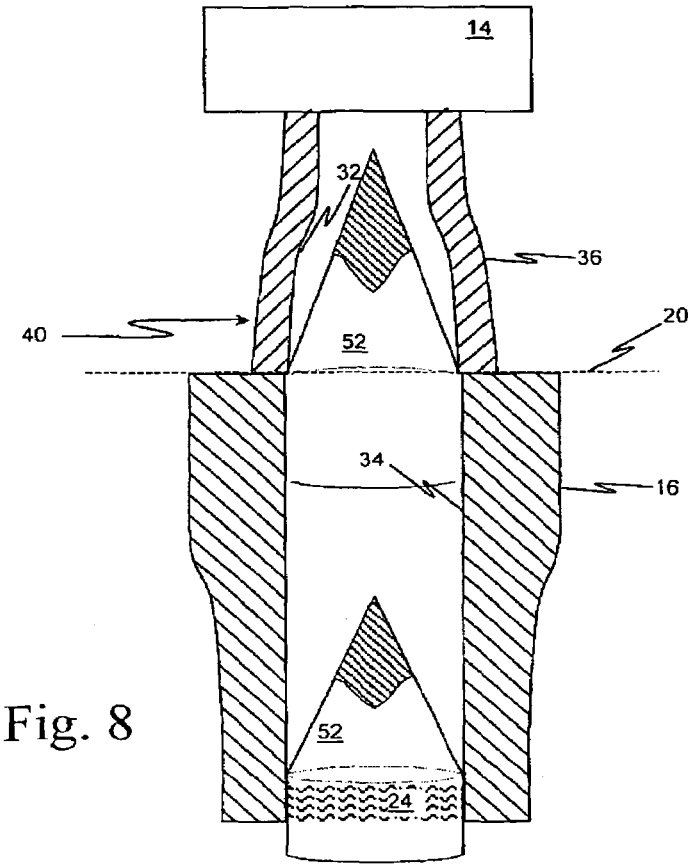
FIG. 8 is a cross-section of detail area 18 of FIG. 1 with the floating riser tube filter of FIG. 7.

Referring now to FIG. 2, detail 18 of FIG. 1 is shown in cross-section. Riser tube 16 contains molten metal 24 and connects casting machine 12 to mold 14. Riser tube filter 30 is contained within riser tube 16. Riser tube filter 30 is generally spherical and formed of ceramic sponge. In a currently preferred embodiment of the present disclosure riser tube filter 30 is formed to have a specific gravity lower than molten metal 24. For casting aluminum, specific gravities less than 1.3 have been used successfully. In a currently preferred embodiment of the present disclosure for casting aluminum a specific gravity of 0.7 for riser tube filter 30 is preferred.

For other metals such as steel or copper specific gravities of about ⅓ of the specific gravity of the molten metal may be preferred. In practice, any specific gravity less than the molten metal may be used.

In a currently preferred embodiment of the present disclosure riser tube filter 30 is 10 ppi ceramic foam. Suitable riser tube filters may be formed of ceramic foam having a filter density of up to about 60 ppi. Riser tube filters may also be formed by combining ceramic foam having different densities to achieve specific performance.

In operation, pressure within casting machine 12 forces molten metal 24 through riser tube 16 raising riser tube filter 30 until riser tube filter 30 contacts inner wall 32 of mold funnel 36 at filtration plane 40. Riser tube filter 30 is sized so that it cannot pass through mold funnel 36. At filtration plane 40, riser tube filter 30 filters molten metal 24 as well as smoothing the flow of molten metal 24 through mold funnel 36.

Upon release of the pressure within casting machine 12, molten metal 24 retracts through riser tube 16. As molten metal 24 withdraws from mold funnel 36, riser tube filter 30 is drawn down through riser tube 16. As riser tube filter 30 passes through riser tube 16, riser tube filter 30 is in contact with inner surface 34 of riser tube 16 thus scrubbing or otherwise abrading any buildup of oxides or other contaminants from inner surface 34. This action occurs twice with each casting, once on the rise and once on withdrawal.

Referring now to FIG. 3-FIG. 6 riser tube filters may have many suitable shapes as illustrated for example by filter 44, filter 46, filter 48 and filter 50. Any other suitable shape may be used. Combining the shapes of filters 44, 46, 48 and 50 with varying foam density may permit tailoring filter performance over a wide range of requirements. For example filter density may be arranged to have helical high density areas within the filter that encourage rotation of the filter about the long axis 13 of riser tube 16 thus scouring the inner wall of the riser tube as the filter rises and as the molten material is forced through the filter.

Figure 7:
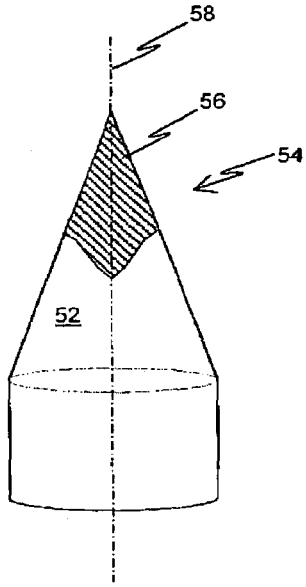
FIG. 7 is a side view of another still further alternate embodiment of a floating riser tube filter according to the present disclosure.

Referring now to FIG. 7, riser tube filter 52 may include area 54 composed of very high density ceramic foam or solid ceramic. In operation as molten metal 24 rises within riser tube 16, riser tube filter 52 is carried into contact with mold funnel 36. Riser tube filter 52 is shaped to extend into mold 14 and filter spreader 56 may replace mold spreader 42 shown in FIG. 2. By combining multiple density foams in riser tube filter 52 in addition to filter spreader 56, riser tube filter 52 may be forced to rotate about axis 58 as molten metal 24 is forced through filter 52 during casting. Many other suitable variations to ceramic foam casting filters may also be used within the scope of this disclosure.

Having now described the invention in accordance with the requirements of the patent statutes, those skilled in the art will understand how to make changes and modifications in the present invention to meet their specific requirements or conditions. Such changes and modifications may be made without departing from the scope and spirit of the invention as set forth in the following claims.

I claim:

1. An apparatus for pressurized metal casting comprising:

a reservoir of molten material;

a mold, having a material inlet;

a mold adapter, engaging the mold at the material inlet;

a riser tube for conducting molten material from the reservoir to the mold adapter; and a ceramic sponge filter, the ceramic sponge filter within the riser tube, floating in the molten material and conducted with the molten material within the riser tube and engaging the mold adapter to filter the molten material.

2. The apparatus of claim 1 wherein the ceramic sponge filter further comprises:

a ceramic sponge filter having a filter density less than 60 ppi.

3. The apparatus of claim 1 wherein the ceramic sponge filter further comprises:

a spherical ceramic sponge filter.

4. The apparatus of claim 1 wherein the ceramic sponge filter further comprises:

a cylindrical ceramic sponge filter.

5. The apparatus of claim 1 wherein the ceramic sponge filter further comprises:

a ovoid ceramic sponge filter.

6. The apparatus of claim 1 wherein the ceramic sponge filter further comprises:

a conic ceramic sponge filter.

7. The apparatus of claim 1 wherein the ceramic sponge filter further comprises:

a cigar shaped ceramic sponge filter.

8. The apparatus of claim 1 wherein the ceramic sponge filter further comprises:

a ceramic sponge filter having a first volume having a first filter density and a second volume having a second filter density.

9. The apparatus of claim 1 wherein the ceramic sponge filter further comprises:

a ceramic sponge filter having a first volume with a first filter density and a second volume with a second filter density.

* * * * *